US006297494B1

(12) United States Patent
Estrera et al.

(10) Patent No.: US 6,297,494 B1
(45) Date of Patent: Oct. 2, 2001

(54) METHOD AND SYSTEM FOR ENHANCED VISION EMPLOYING AN IMPROVED IMAGE INTENSIFIER WITH A GATED POWER SUPPLY AND REDUCED HALO

(75) Inventors: Joseph P. Estrera, Dallas, TX (US); Michael J. Iosue, Phoenix, AZ (US); Michael R. Saldaña, New Braunfels, TX (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/326,148

(22) Filed: Jun. 4, 1999

(51) Int. Cl.[7] ..... H01J 40/14
(52) U.S. Cl. ..... 250/214 VT; 313/103 CM
(58) Field of Search ..... 250/214 VT, 214.1, 250/214 R, 207; 313/103 CM, 105 CM, 103 R, 105 R

(56) References Cited

U.S. PATENT DOCUMENTS 4,024,390 * 5/1977 Bosserman et al. ..... 250/214 VT
5,776,538 * 7/1998 Pierle et al. ..... 427/78
6,072,565 * 6/2000 Porter ..... 356/5.04

* cited by examiner

*Primary Examiner*—Que T. Le
(74) *Attorney, Agent, or Firm*—Baker Botts L.L.P.

(57) ABSTRACT

The present invention comprises a method for detecting photons and generating a representation of an image. A photocathode receives photons from an image. A power supply to the photocathode is gated such that the photocathode is switched between an on state and an off state. The photocathode discharges electrons in response to the received photons while the photocathode is in the on state. A microchannel plate is located no more than about 125 microns from the photocathode. The microchannel plate has an unfilmed input face and an output face that receives the electrons from the photocathode. The microchannel plate produces secondary emission electrons which are emitted from the output face. A screen receives the secondary electrons and displays a representation of the image.

20 Claims, 3 Drawing Sheets

METHOD AND SYSTEM FOR ENHANCED VISION EMPLOYING AN IMPROVED IMAGE INTENSIFIER WITH A GATED POWER SUPPLY AND REDUCED HALO

RELATED APPLICATIONS

This application is related to copending U.S. application Ser. No. 09/326,253, entitled "METHOD AND SYSTEM FOR ENHANCED VISION EMPLOYING AN IMPROVED IMAGE INTENSIFIER", copending U.S. application Ser. No. 09/325,359, entitled "METHOD AND SYSTEM FOR ENHANCED VISION EMPLOYING AN IMPROVED IMAGE INTENSIFIER AND GATED POWER SUPPLY", copending U.S. application Ser. No. 09/326,252, entitled "METHOD AND SYSTEM FOR ENHANCED VISION EMPLOYING AN IMPROVED IMAGE INTENSIFIER AND REDUCED HALO", and copending U.S. application Ser. No. 09/326,054, entitled "METHOD AND SYSTEM FOR MANUFACTURING MICROCHANNEL PLATES" now U.S. Pat. No. 6,049,168.

TECHNICAL FIELD OF THE INVENTION

This invention relates generally to vision systems and more particularly to a method and system for enhanced vision employing an improved image intensifier with a gated power supply and reduced halo.

BACKGROUND OF THE INVENTION

Image intensifier tubes are used in night vision devices to amplify light and allow a user to see images in very dark conditions. Night vision devices typically include a lens to focus light onto the light receiving end of an image intensifier tube and an eyepiece at the other end to view the enhanced imaged produced by the image intensifier tube.

Modern image intensifier tubes use photocathodes. Photocathodes emit electrons in response to photons impinging on the photocathodes. The electrons are produced in a pattern that replicates the original scene. The electrons from the photocathode are accelerated towards a microchannel plate. A microchannel plate is typically manufactured from lead glass and has a multitude of microchannels, each one operable to produce a cascade of secondary electrons in response to an incident electron.

Therefore, photons impinge on the photocathode producing electrons which are then accelerated to a microchannel plate where a cascade of secondary electrons are produced. These electrons impinge on a phosphorous screen, producing an image of the scene.

A drawback to this approach is that the electrostatic fields in the image intensifier are not only effective in accelerating electrons from the photocathode to the microchannel plate and from the microchannel plate to the screen, but also move any positive ions back to the photocathode at an accelerated velocity. Current image intensifiers have a high indigenous population of positive ions. These are primarily due to gas ions in the tube, including in the microchannel plate and the screen. These include both positive ions and chemically active neutral atoms. When these ions strike the photocathode, they can cause both physical and chemical damage. This leads to short operating lives for image intensifiers.

To overcome this problem, an ion barrier film can be placed on the input side of the microchannel plate. This ion barrier is able to block the ions from the photocathode. One drawback of the ion barrier is that it reduces the signal-to-noise ratio of the image intensifier. This is due to the fact that the barrier prevents low energy electrons from reaching the microchannel plates. Another drawback of the ion barrier film is that it contributes to a halo effect in the image produced by the image intensifier tube. In addition, modern image intensifier tubes have a relatively large gap between the photocathode and the microchannel plate. This gap also contributes to the halo effect problem.

Therefore, current image intensifiers require an ion barrier since current manufacturing techniques fail to remove enough gas molecules. But the presence of the ion barriers reduces the signal-to-noise ratio and contributes to the halo effect. What is needed is an unfilmed microchannel plate that has a sufficient number of gas ions removed such that an image intensifier manufactured with such a microchannel plate has a usable life.

Modern image intensifier tubes also provide automatic brightness control (ABC) and bright source protection (BSP). ABC maintains a relatively constant level of brightness in the image produced by the image intensifier tube despite fluctuating levels of brightness in the scene being viewed. BSP prevents the image intensifier tube from being damaged by high levels of current that may otherwise be generated in response to an extremely bright source.

Conventional image intensifier tubes provide ABC and BSP by adjusting the voltage level of the microchannel plate. Thus, for a brighter scene, the voltage to the microchannel plate is reduced. A drawback to this approach is that the image intensifier tube loses resolution as the voltage to the microchannel plate is reduced. What is needed is an image intensifier tube that provides ABC and BSP without a loss in resolution as the brightness increases.

SUMMARY OF THE INVENTION

In accordance with the present invention, the disadvantages and problems associated with previous image intensifiers have been substantially reduced or eliminated. In particular, the present invention provides a method and system for enhanced vision employing an improved image intensifier with a gated power supply and reduced halo.

In one embodiment, a method is provided for detecting photons and generating a representation of an image. A photocathode receives photons from an image. A power supply to the photocathode is gated such that the photocathode is switched between an on state and an off state. The photocathode discharges electrons in response to the received photons while the photocathode is in the on state. A microchannel plate is located no more than about 125 microns from the photocathode. The microchannel plate has an unfilmed input face and an output face that receives the electrons from the photocathode. The microchannel plate produces secondary emission electrons which are emitted from the output face. A screen receives the secondary electrons and displays a representation of the image.

Technical advantages of the present invention include providing an image enhancer with improved automatic brightness control and bright source protection. In particular, an image enhancer provides automatic brightness control and bright source protection without a significant loss in resolution as brightness increases. Another technical advantage of the present invention includes providing an image enhancer with reduced halo. In particular, an image enhancer provides a reduced halo by reducing the gap between the photocathode and the microchannel plate and by using an unfilmed microchannel plate.

Other technical advantages of the present invention will be readily apparent to those skilled in the art from the following figures, descriptions and claims.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

The preferred embodiment of the present invention and its advantages are best understood by referring to FIGS. 1 through 5 of the drawings, like numerals being used for like and corresponding parts of the various drawings.

Figure 1:
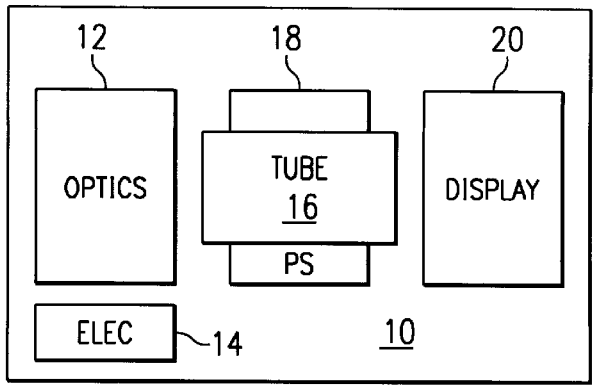
FIG. 1 is a schematic design of an image intensifier in accordance with the teachings of the present invention

FIG. 1 is a schematic design of an image intensifier 10 in accordance with the teachings of the present invention. Image intensifier 10 is operable to receive photons from an image and transform them into a viewable image. Image intensifier 10 is designed to operate and enhance viewing in varying light conditions including conditions where a scene is visible with natural vision and conditions where a scene is totally invisible with natural vision because the scene is illuminated only by star light or other infrared light sources. However, it will be understood that, although the image intensifier 10 may be used to enhance vision, the image intensifier 10 may also be used in other applications involving photon detection such as systems to inspect semiconductors.

Image intensifier 10 comprises optics 12 coupled to image intensifier tube 16. Power supply 18 is coupled to image intensifier tube 16. Image intensifier tube 16 also can include an image visualization means 20 for viewing the image produced by image intensifier 10.

Optics 12 are generally one or more lens elements used to form an objective optical assembly. Optics 12 are operable to focus light from a scene on to image intensifier tube 16.

Power supply 18 is operable to provide power to components of image intensifier tube 16. In a typical embodiment power supply 18 provides continuous DC power to image intensifier tube 16. The use of power supply 18 is further described in conjunction with FIG. 2.

Electronics 14 represents the other electronic necessary for image intensifier 10. These include electronics that are used to control among other things, power supply 16.

Image visualization means 20 is operable to provide a convenient display for images generated at image intensifier tube 16. Display 20 may be as simple as a lens or can be a cathode ray tube (CRT) display.

Figure 2:
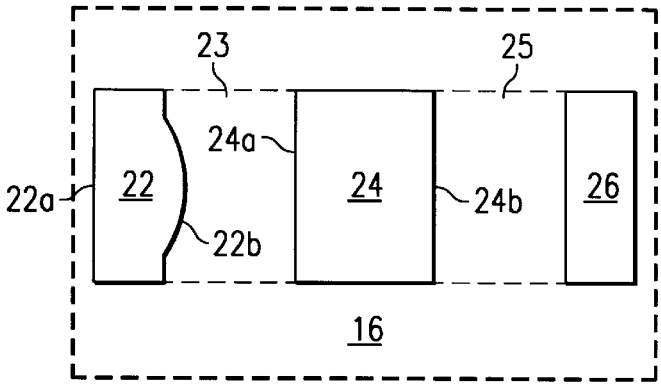
FIG. 2 illustrates an image intensifier tube in accordance with the teachings of the present invention.

FIG. 2 illustrates an image intensifier tube 16 in accordance with the teachings of the present invention. Image intensifier tube 16 comprises a photocathode 22 having a input side 22*a* and an output side 22*b*. Coupled to photocathode 22 is a microchannel plate (MCP) 24 having a MCP input side 24*a* and a MCP output side 24*b*. A first electric field 23 is located between photocathode 22 and microchannel plate 24. Also included is a phosphorous screen 26 coupled to microchannel plate 24. Between phosphorous screen 26 and microchannel plate 24 is a second electric field 25.

In operation, photons from an image impinge on input side of photocathode 22*a*. Photocathode 22 converts photons into electrons, which are emitted from output side of photocathode 22*b* in a pattern representative of the original image. Typically, photocathode 22 is a circular disk like structure manufactured from semiconductor materials mounted on a substrate as is well known in the art. One suitable arrangement is gallium arsenide (GaAs) mounted on glass, fiber optics or similarly transparent substrate.

The electrons emitted from photocathode 22 are accelerated in first electric field 23. First electric field 23 is generated by power supply 18. After accelerating in first electric field 23, the electrons impinge on the input side 24*a* of microchannel plate 24. Microchannel plate 24 typically comprises a thin glass wafer formed from many hollow fibers, each oriented slightly off axis with respect to incoming electrons. Microchannel plate 24 typically has a conductive electrode layer disposed on MCP input side 24*a* and MCP output side 24*b*. A differential voltage, supplied by power supply 18, is applied across the MCP input 24*a* and MCP output 24*b*. Electrons from photocathode 22 enter microchannel plate 24 where they produce secondary electrons, which are accelerated by the differential voltage. The accelerated secondary electrons leave microchannel plate 24 at MCP output 24*b*.

As discussed earlier, typical current microchannel plates contain an ion barrier on the input side in order to protect the photocathode from positive ions that travel from the MCP to the photocathode. These ions are typically gas ions trapped in the glass of the microchannel plate during processing. These ions are usually large and can cause physical and chemical damage to the photocathode if liberated from the microchannel plate and allowed to strike the photocathode. For conventional microchannel plates this problem leads to a very short image intensifier life (260 to 300 hours) when the ion barrier is not present. However, as discussed earlier, the ion barrier reduces the signal to noise ratio of image intensifier 10.

In the present invention, a microchannel plate without an ion barrier is provided for use in an image intensifier. In the present invention, even though the microchannel plate has no ion barrier, the life of the image intensifier is long (over 7,500 hours). Additionally, the signal to noise ratio is also very large (at least 27 to 1). This is achieved by providing a microchannel plate that is practically free from harmful ions.

After exiting microchannel plate 24 and accelerating in second electric field 25, secondary electrons impinge on phosphorous screen 26, where a pattern replicating the original image is formed. Other ways of displaying an image such as using a charged coupled device can also be used.

Figure 3:
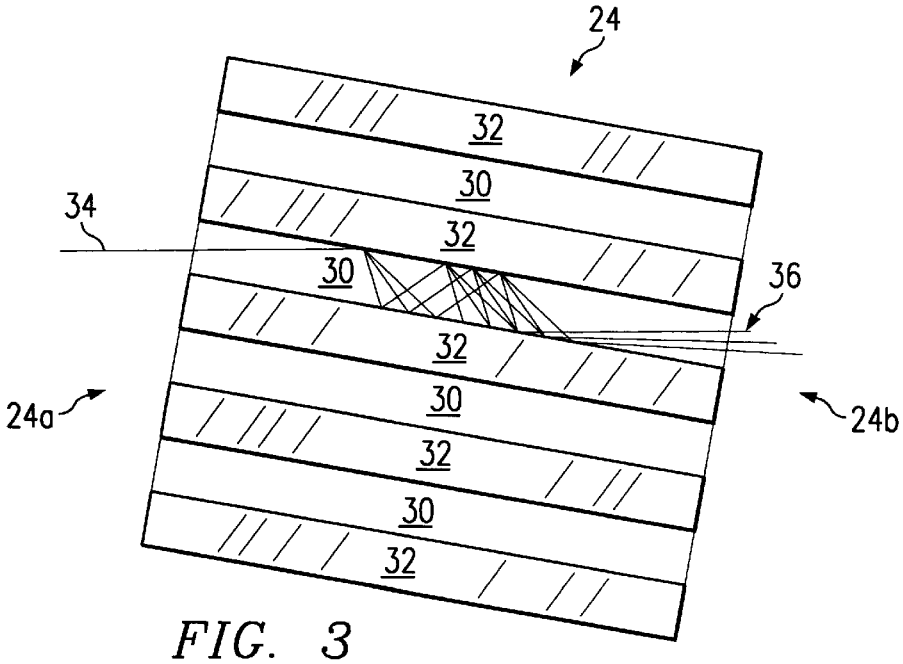
FIG. 3 illustrates a microchannel plate in accordance with the teachings of the present invention.

FIG. 3 illustrates a microchannel plate 24 in accordance with the teachings of the present invention. Illustrated is microchannel plate 24 comprising microchannel plate channels 30 and glass borders 32. As is illustrated in FIG. 3, incoming electrons 34 produce secondary emission electrons 36 by interactions in MCP 24.

In the present invention MCP input side 24*a* does not have an ion barrier film applied. The cladding glass used to manufacture microchannel plate 24 is made electrically conductive to produce secondary emission electrons and can be scrubbed to substantially reduce the amount of damaging ions. An example of suitable cladding glass is disclosed in U.S. Pat. No. 5,015,909, issued to Circon Corporation on May 14, 1991 and entitled "Glass composition and method for manufacturing a high performance microchannel plate". Other similar cladding glass material can also be used. As discussed earlier, each face (MCP input side 24*a* and MCP output side 24*b*) are made to act as electrodes. This is done by depositing a metallic coating such as Nichrome on the MCP input side 24*a* and MCP output side 24*b*. The channels are treated in such a way that incoming electrons produce secondary emission electrons. This is typically done by forming a semi-conducting layer in channels 30. The manufacture of a microchannel plate sufficiently low in ions such that it can be used unfilmed in an image intensifier is discussed in conjunction with FIG. 4.

As described above, the first electric field 23 exists in the gap between the photocathode 22 and the MCP 24. As electrons travel through this field 23, the electrons tend to spread out, forming a halo around the image produced at the screen 26. In addition, some of the electrons are scattered by the MCP 24 and return to the MCP 24 at an even greater distance away from the location where they exited the photocathode 22. Some of the electrons that are scattered by the MCP 24 will be scattered by the MCP 24 again when they return. Thus, a halo effect is created as the image displayed on the screen 26 to a user of the image intensifier 10 includes a spread of light where the original scene has only a small point of light. This halo effect reduces the quality of the image produced by the image intensifier 10.

The ion barrier film used in conventional image intensifiers also contributes to this halo effect. Electrons may be scattered by the ion barrier film itself, adding to the halo effect. In addition, the ion barrier film may act as a gain for electrons below a particular energy value, allowing those electrons to contribute to the halo effect.

Therefore, the present invention provides an improved image intensifier 10 by reducing the halo effect in two different ways. First of all, the gap between the photocathode 22 and the MCP 24 is reduced. Conventional image intensifiers generally include a gap of approximately 250 microns or more. The present invention reduces this gap to at most 75–125 microns. Thus, the electrons have a significantly reduced distance to travel between the photocathode 22 and the MCP 24, which causes a corresponding reduction in the spread of the electrons before impacting the MCP 24. This gap reduction is accomplished by eliminating contaminants and providing cleaner surfaces to minimize irregularities and/or particulates on the photocathode 22.

In addition, the reduced gap between the photocathode 22 and the MCP 24 allows a corresponding reduction in the voltage required for the photocathode 22. This is due to the fact that a smaller voltage will provide the same strength electric field over a smaller distance. Therefore, the halo effect is minimized and the photocathode 22 voltage requirements are reduced by placing the photocathode 22 closer to the MCP 24.

The second way that the halo effect is reduced by the present invention is that the ion barrier film is removed. Thus, the electrons will not be scattered by the ion barrier film, and low energy electrons will not be provided with a gain to increase their opportunities to be scattered by either the film or the MCP 24. Thus, the halo effect is minimized by reducing the gap between the photocathode 22 and the MCP 24 and by removing the ion barrier film.

Figure 4:
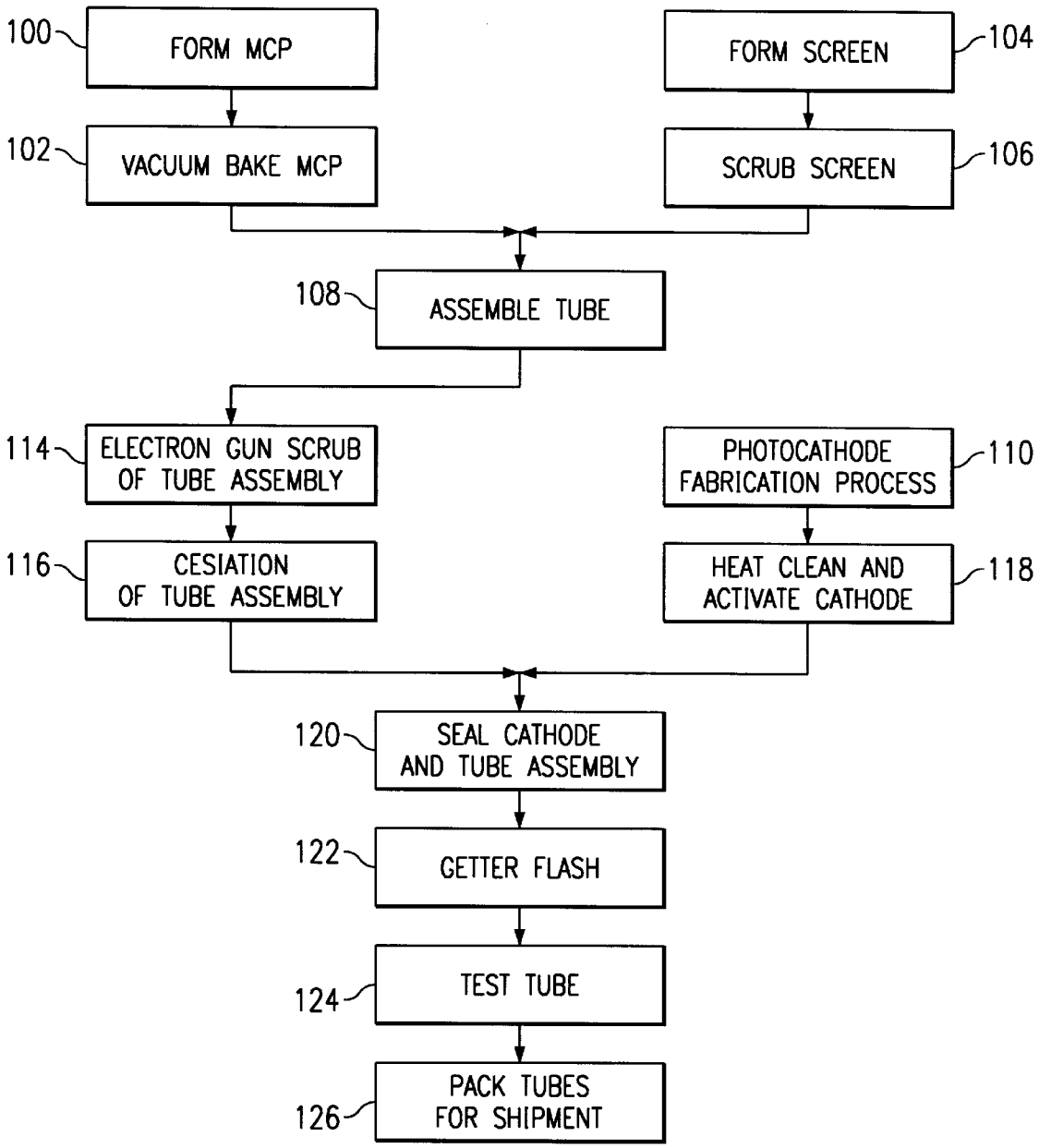
FIG. 4 is a flowchart illustrating the formation of an enhanced image device utilizing an unfilmed microchannel plate.

FIG. 4 is a flowchart illustrating the formation of an enhanced image device utilizing an unfilmed microchannel plate. In Step 100, a microchannel plate is formed. Microchannel plates are typically formed using a draw/multidraw technique in which many individual tubes are drawn (pulled) along a long axis several times to reduce the width of the tubes. The tubes are then sliced into individual microchannel plates.

In Step 102, the microchannel plate is baked in a vacuum to drive off ions, such as gas ions, in the microchannel plate. In Step 104, the phosphorus screen or CCD is prepared. In Step 106, the screen is scrubbed to remove unwanted gas impurities such as carbon dioxide, carbon monoxide, hydrogen gas and other impurities. In Step 108, the MCP and screen are placed together in a ceramic or metal input body to form a tube assembly.

In Step 110, a photocathode is formed. The photocathode is typically formed from a semiconductor with GaAs or InGaAs layer on a transparent substrate.

In Step 114, the tube assembly undergoes an electron beam scrub. The electron beam scrub uses a high-energy electron beam to drive out gas impurities that might later contribute to damaging ions. Typically a high intensity electron beam scrub is done over a long period of time.

One drawback to such an electron beam scrub of an unfilmed microchannel plate is that the intensity maybe such that the electrons leaving the MCP could burn a hole, or other wise damage, the phosphorous screen. To avoid this, the focus of the electron beam must be set to diffuse the high energy electrons before they reach the screen.

In Step 116, the tube assembly goes through a cesiation process. Cesium is a good gas eliminator (also known as a gas getter) which is used to remove even more gas based impurities from the screen and microchannel plate.

In Step 118, the photocathode undergoes a heat cleaning and a cesium activation step. In the heat cleaning step, the photocathode is heated in a vacuum to drive off any oxide layers. Next, a cesium activation step is performed. This is done to form a cesium and oxygen layer on top of the photocathode to protect the photocathode. This is done using a conventional process, which exposes the photocathode to cesium until an optimal amount of cesium is placed on the photocathode.

After Steps 116 and 118, the MCP/screen elements are assembled together in step 120. In Step 122, a wire of Ti/Ta is used as a final gas getter to remove any last impurities. After this is completed, the tube is tested in Step 126 after the finally tube assembly occurs in Step 126.

Figure 5:
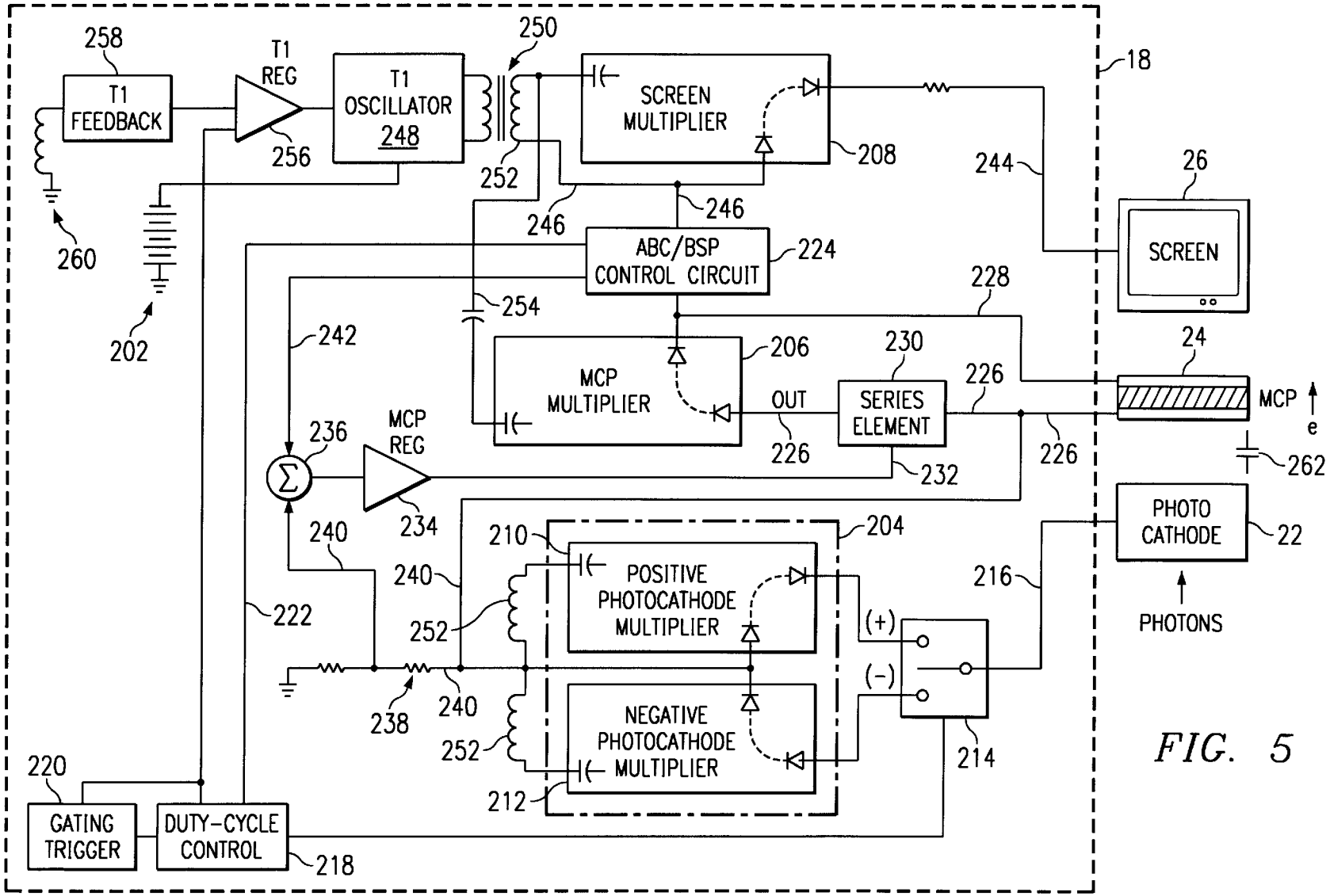
FIG. 5 is a schematic drawing illustrating a gated power supply for an image intensifier tube in accordance with one embodiment of the present invention.

FIG. 5 is a schematic drawing illustrating a gated power supply 18 for an image intensifier 10 in accordance with one embodiment of the present invention. The gated power supply 18 provides a relatively constant brightness for the image seen by a user of the image intensifier 10. The power supply 18 comprises a power source 202 which is illustrated in FIG. 5 as a battery. It will be understood, however, that the power source 202 may comprise a regulated line power source or other suitable source of power.

The power supply 18 comprises three voltage multipliers 204, 206 and 208. These include a photocathode multiplier 204, an MCP multiplier 206 and a screen multiplier 208. The photocathode multiplier 204 comprises a positive photocathode multiplier 210 and a negative photocathode multiplier 212. The positive photocathode multiplier 210 provides a voltage level that is positive with respect to the input 24*a* of the MCP 24, and the negative photocathode multiplier 212 provides a voltage that is negative with respect to the input 24*a* of the MCP 24.

The photocathode 22 may be coupled to a tri-stable switching network 214 through a conductor 216. The switching network 214 may couple the photocathode 22 to the positive photocathode multiplier 210 or to the negative photocathode multiplier 212. In addition, the photocathode 22 may be in an open circuit position in which the conductor 216 terminates in an open circuit within the switching network 214. As an alternative, the switching network 214 may be configured to switch between the positive photocathode multiplier 210 and the negative photocathode multiplier 212 without an open circuit position being available.

A duty cycle control 218 receives a square wave gating trigger signal from an oscillator 220 and a control signal through a conductor 222 from an ABC/BSP control circuit 224. The duty cycle control 218 controls the position of the switch within the switching network 214. Thus, the duty cycle control 218 determines whether the photocathode 22 is coupled to the positive photocathode multiplier 210, the negative photocathode multiplier 212, or the open circuit position.

Power is supplied to the MCP 24 from the MCP multiplier 206 through lines 226 and 228. In one embodiment, line 226 includes a series element 230 that is coupled between the MCP multiplier 206 and the MCP 24. In an alternative embodiment, however, line 226 does not include the series element 230. The series element 230 may be a variable resistor, such as a high voltage MOSFET. The resistance of the series element 230 is controlled through a conductor 232 by a regulator circuit 234. The regulator circuit 234 receives a feedback control signal from a summing junction 236. The summing junction 236 receives an input from a level adjusting resistor 238 through a conductor 240 and an input from the ABC/BSP control circuit 224 through a conductor 242. The conductor 240 also provides to the photocathode multiplier 204 a feedback signal of the voltage level at the input 24*a* of the MCP 24.

The screen multiplier 208 is coupled to the screen 26 through a conductor 244 and provides to the ABC/BSP control circuit 224 a feedback of the current level of the screen 26 through lines 246. An oscillator 248 provides energy flow to the power supply 18 through a transformer 250. The transformer 250 provides energy to the photocathode multiplier 204 and the screen multiplier 208 through output windings 252 and to the MCP multiplier 206 through a conductor 254. The oscillator 248 receives a control feedback from a regulator 256 and a feedback circuit 258 that has an input from a feedback winding 260 of the transformer 250.

In operation, the photocathode 22 functions as described above in connection with FIG. 2 when the switch in the switching network 214 couples the photocathode 22 to the negative photocathode multiplier 212. In this configuration, the power supply 18 provides a constant negative voltage to the photocathode 22 through the negative photocathode multiplier 212. In one embodiment, this voltage level is approximately −800 volts. However, when the switch in the switching network 214 couples the photocathode 22 to the positive photocathode multiplier 210, the photocathode 22 is no longer responsive to photons and is essentially forced into a non-functioning state. In this configuration, the power supply 18 provides a constant positive voltage to the photocathode 22 through the positive photocathode multiplier 210. In one embodiment, this voltage level is approximately +30 volts with reference to the input 24*a* of the MCP 24.

Therefore, the power supply 18 provides a gating function by turning the photocathode 22 on and off at specified intervals such that the current or voltage level of a particular component is kept within a specified range. The length of these specified intervals is controlled by the duty cycle control 218. In one embodiment, the duty cycle control 218 determines the interval based on the current level of the screen 26. Alternatively, the duty cycle control 218 determines the interval based on the current level at the output 24*b* of the MCP 24. It will be understood, however, that the length of the specified intervals may be based on current or voltage levels of other suitable components of the image intensifier tube 16.

For the embodiment in which the interval is based on the current level of the screen 26, the power supply 18 provides continuous power to the photocathode 22 through the negative photocathode multiplier 212 until the current level of the screen 26 reaches a peak value. At that point, the duty cycle control 218 begins to switch the switching network 214 at a specified interval in order to maintain the current level of the screen 26 below the peak value. The specified interval is the amount of time that the photocathode 22 is in an off state. For example, the duty cycle control 218 may place the photocathode 22 in an on state by coupling to the negative photocathode multiplier 212. The photocathode 22 is later placed in an off state by coupling to the positive photocathode multiplier 210. After the specified interval has passed, the photocathode 22 is again placed in an on state by coupling to the negative photocathode multiplier 212, and the cycle continues.

As the current level of the screen 26 attempts to rise farther above the peak value, the duty cycle control 218 lengthens the interval to maintain the current level of the screen 26. However, the interval may reach a maximum length after which the duty cycle control 218 may not continue to lengthen the interval. In one embodiment, the duty cycle control 218 provides an interval that allows the photocathode 22 to operate between about $10^{-4}$% and 100% of the time. Thus, the duty cycle control 218 may not lengthen the interval beyond the point at which the photocathode 22 is on for only about $10^{-4}$% of the time.

Once the interval has reached this maximum length, the power supply 18 may compensate for the rising current level of the screen 26 by decreasing the voltage level applied to the MCP 24. This may be accomplished by the MCP regulator 234 increasing the resistance of the series element 230. As described above, the MCP regulator 234 receives input from the level adjusting resistor 238 and the ABC/BSP control circuit 224, which is responsive to the current level of the screen 26 by way of lines 246.

When the duty cycle control 218 is gating the power to the photocathode 22 at a specified interval, the voltage provided at the photocathode 22 alternates between the negative voltage provided by the negative photocathode multiplier 212 and the positive photocathode multiplier 210. However, the voltage at the photocathode 22 decays slightly when the switch in the switching network 214 moves from the negative photocathode multiplier 212 to the positive photocathode multiplier 210. Thus, when the switch is in an open circuit position, the voltage at the photocathode 22 begins to decay. This decay is relatively small because of the capacitance between the photocathode 22 and the MCP 24, illustrated in FIG. 5 as a virtual capacitor 262.

While the invention has been particularly shown and described by the foregoing detailed description, it will be understood by those skilled in the art that various other changes in form and detail may be made without departing from the spirit and scope of the invention.

What is claimed is:

1. A method for detecting photons and generating a representation of an image, comprising:

receiving photons from the image at a photocathode;

gating a power supply to the photocathode such that the photocathode is switched between an on state and an off state;

discharging electrons from the photocathode in response to the received photons while the photocathode is in the on state;

locating a microchannel plate no more than about 125 microns from the photocathode, the microchannel plate comprising approximately no impurities;

accelerating electrons towards an unfilmed input face of the microchannel plate, the unfilmed input face free of an ion barrier film;

receiving electrons at the unfilmed input of the microchannel plate;

generating secondary emission electrons in the microchannel plate in response to the received electrons;

discharging the secondary emission electrons from an output face of the microchannel plate;

accelerating secondary emission electrons to a screen; and displaying a representation of the image at the screen.

2. The method of claim 1, further comprising discharging no electrons from the photocathode in response to received photons while the photocathode is in the off state.

3. The method of claim 1, wherein the photocathode and the microchannel plate are provided as part of an image intensifier tube.

4. The method of claim 3, wherein the image intensifier tube is used for night vision devices.

5. The method of claim 3, wherein the image intensifier tube has a lifetime of at least 7,500 hours.

6. The method of claim 1, wherein the act of locating the microchannel plate no more than about 125 microns from the photocathode comprises locating the microchannel plate about 75 to about 125 microns from the photocathode.

7. A device for photon detection and image generation, comprising:

a photocathode operable to receive photons from an image;

a gated power supply operable to switch the photocathode between an on state and an off state, wherein the photocathode is operable to discharge electrons in response to the received photons while in the on state and operable to discharge no electrons in response to the received photons while in the off state;

a microchannel plate having an unfilmed input face and an output face, the unfilmed input face free of an ion barrier film, the microchannel plate receiving the electrons from the photocathode and producing secondary emission electrons in response, the secondary electrons emitting from the output face, the microchannel plate located no more than about 125 microns from the photocathode, the microchannel plate comprising approximately no impurities; and a screen operable to receive the secondary emission electrons and display a representation of the image.

8. The device of claim 7, wherein the microchannel plate is located about 75 to about 125 microns from the photocathode.

9. The device of claim 7, wherein the photocathode and the microchannel plate are provided as part of an image intensifier tube.

10. The device of claim 9, wherein the image intensifier tube is used for night vision devices.

11. The device of claim 9, wherein the lifetime of the image intensifier tube is more than 7,500 hours.

12. A method for gating a power supply to a photocathode in a device for photon detection and image generation while reducing a halo effect, the device comprising an unfilmed microchannel plate and a phosphorous screen, the method comprising:

locating the microchannel plate no more than about 125 microns from the photocathode, the microchannel plate free of an ion barrier film and comprising approximately no impurities;

generating a negative voltage with a negative voltage source;

generating a positive voltage with a positive voltage source;

providing a switching network operable to couple the photocathode to the negative voltage source and the positive voltage source; and alternatively coupling the photocathode to the negative voltage source and the positive voltage source at a specified interval.

13. The method of claim 12, wherein the act of locating the microchannel plate no more than about 125 microns from the photocathode comprises locating the microchannel plate about 75 to about 125 microns from the photocathode.

14. The method of claim 12, wherein the negative voltage source and the positive voltage source comprise voltage multipliers.

15. The method of claim 12, further comprising coupling a duty cycle control to the switching network, the duty cycle control operable to switch the photocathode from the negative voltage source to the positive voltage source at a specified interval.

16. The method of claim 15, wherein the duty cycle control determines the specified interval based upon a current level of the phosphorous screen.

17. The method of claim 15, wherein the duty cycle control determines the specified interval based upon a current level of the microchannel plate.

18. The method of claim 15, further comprising reducing a voltage level applied by a microchannel plate voltage source to the microchannel plate in response to the specified interval reaching a maximum length.

19. The method of claim 18, further comprising coupling a variable impedance element between the microchannel plate voltage source and the microchannel plate and wherein the act of reducing the voltage level comprises increasing an impedance of the variable impedance element.

20. The method of claim 18, wherein the act of reducing the voltage level comprises reducing the voltage level based on a current level of the phosphorous screen.

* * * * *